US009804557B2

(12) United States Patent
Hwang

(10) Patent No.: US 9,804,557 B2
(45) Date of Patent: Oct. 31, 2017

(54) DEVELOPING DEVICE ATTACHABLE TO ELECTROPHOTOGRAPHIC IMAGE FORMING APPARATUS

(71) Applicant: SAMSUNG ELECTRONICS CO., LTD., Suwon-si, Gyeonggi-do (KR)

(72) Inventor: Ho-hyun Hwang, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/139,876

(22) Filed: Apr. 27, 2016

(65) Prior Publication Data

US 2017/0017197 A1 Jan. 19, 2017

(30) Foreign Application Priority Data

Jul. 13, 2015 (KR) ..... 10-2015-0099226

(51) Int. Cl.

| | |
|---|---|
| ***G03G 15/00*** | (2006.01) |
| ***G03G 21/16*** | (2006.01) |
| ***G03G 15/08*** | (2006.01) |
| ***G03G 21/18*** | (2006.01) |

(52) U.S. Cl.

CPC ..... *G03G 21/1652* (2013.01); *G03G 15/0863* (2013.01); *G03G 21/1878* (2013.01)

(58) Field of Classification Search

CPC ..... G03G 15/0863; G03G 21/1652; G03G 21/1878

See application file for complete search history.

(56) References Cited

U.S. PATENT DOCUMENTS

| | | | | |
|---|---|---|---|---|
| 9,625,876 | B2 * | 4/2017 | Watanabe | G03G 21/18 |
| 2006/0228127 | A1 * | 10/2006 | Miyabe | G03G 21/1867 399/90 |
| 2008/0199204 | A1 | 8/2008 | Ishii et al. | |
| 2009/0196647 | A1 * | 8/2009 | Nishimoto | G03G 21/1871 399/90 |
| 2011/0129252 | A1 * | 6/2011 | Oda | G03G 21/1821 399/119 |

FOREIGN PATENT DOCUMENTS

| | | |
|---|---|---|
| JP | 2006-91387 | 4/2006 |
| JP | 2008-257124 | 10/2008 |

OTHER PUBLICATIONS

Extended European Search Report dated Dec. 19, 2016 in related European Patent Application No. 16168487.3.

* cited by examiner

*Primary Examiner* — Francis Gray
(74) *Attorney, Agent, or Firm* — Staas & Halsey LLP

(57) ABSTRACT

Provided is an electrophotographic image forming apparatus including a developing device attached to/detached from a main body; a memory unit provided in the developing device to transfer information related to the developing device to the main body, and a contact portion for connecting to the main body; and a connection portion provided in the main body, and connecting to the contact portion when the developing device is attached to the main body, wherein one of the connection portion and the contact portion has a first location, where the connection portion or the contact portion is inclined with respect to the first direction of the developing device, and a second location, where the connection portion or the contact portion is in parallel with the first direction.

20 Claims, 12 Drawing Sheets

DEVELOPING DEVICE ATTACHABLE TO ELECTROPHOTOGRAPHIC IMAGE FORMING APPARATUS

CROSS-REFERENCE TO RELATED APPLICATIONS

This application claims the benefit of Korean Patent Application No. 10-2015-0099226, filed on Jul. 13, 2015, in the Korean Intellectual Property Office, the disclosure of which is incorporated herein in its entirety by reference.

BACKGROUND OF THE INVENTION

1. Field of the Invention

The present disclosure relates to electrophotographic image forming apparatuses and developing devices attached to/detached from the electrophotographic image forming apparatuses.

2. Description of the Related Art

An image forming apparatus of an electrophotographic type prints images on a recording medium by forming a visible toner image on a photosensitive member by supplying a toner onto an electrostatic latent image formed on the photosensitive member, transferring the toner image onto the recording medium, and fusing the toner image in the recording medium.

A developing device is an assembly of components for forming a visible toner image, and may be attached to/detached from a main body of an image forming apparatus. A developing device may be replaced when lifespan thereof has ended. A developer cartridge contains a toner therein, and supplies the toner to a developing device. When the toner contained in the developer cartridge is all consumed up, the developer cartridge may be replaced independently from the developing device.

A developing device includes a memory unit storing various types of information about the developing device. The memory unit is electrically connected to a main body to communicate with the main body when the developing device is attached to the main body, and transfers information about the developing device to the main body. The memory unit has a contact portion that is electrically connected to a connection portion of the main body.

SUMMARY OF THE INVENTION

Provided are electrophotographic image forming apparatuses and developing devices, in which a memory unit may is stably connected to a connection portion of a main body of the electrophotographic image forming apparatus.

Provided are electrophotographic image forming apparatuses capable of preventing contamination on a connection portion provided in a main body.

Additional aspects will be set forth in part in the description which follows and, in part, will be apparent from the description, or may be learned by practice of the presented embodiments.

According to an aspect of an embodiment, an electrophotographic image forming apparatus includes: a main body; a developing device attached to/detached from the main body; a memory unit provided in the developing device to transfer information about the developing device to the main body, and a contact portion for connecting to the main body; and a connection portion provided in the main body, and connecting to the contact portion when the developing device is attached to the main body, wherein one of the connection portion and the contact portion has a first location, wherein the connection portion or the contact portion is inclined with respect to an attaching direction of the developing device, and a second location, wherein the connection portion or the contact portion is in parallel with the attaching direction.

The connection portion may be supported by the main body to be switched to the first location or the second location.

The contact portion may extend in the attaching direction, and the connection portion may be inclined downwardly with respect to the attaching direction at the first location.

The connection portion may be supported by the main body so as to rotatable to the first location or the second location.

The electrophotographic image forming apparatus may further include a stopper for blocking the connection portion not to further rotate beyond the second location.

The connection portion may include an insertion hole, through which the contact portion is inserted, and a guide rib provided at an upper side portion of the insertion hole to guide the contact portion toward the insertion hole.

The electrophotographic image forming apparatus may further include an elastic member providing the connection portion with an elastic force in a direction of returning the connection portion to the first location.

The electrophotographic image forming apparatus may further include: a guide rail provided in the main body, and including an inclined section that is inclined downwardly with respect to the attaching direction, and a horizontal section extending in the attaching direction; and two or more guide protrusions provided on the connection portion and inserted in the guide rail, wherein the connection portion may be guided to the inclined section or the horizontal section by being pushed by the contact portion, to be switched from the first location to the second location when the developing device is attached to the main body. The electrophotographic image forming apparatus may further include an elastic member for providing the connection portion with an elastic force in a direction of returning the connection portion to the first location.

The connection portion may be fixed at a location, and the contact portion may be supported by the developing device to be rotatable to the first location or the second location.

The contact portion may be upwardly inclined with respect to the attaching direction at the first location.

The electrophotographic image forming apparatus may further include an elastic member for providing the contact portion with an elastic force in a direction of returning the contact portion to the first location.

According to one or more embodiments, a developing device attached to/detached from a main body of an image forming apparatus, the developing device includes: a memory unit for transferring information about the developing device to the main body and including a contact portion to be connected to the main body, wherein the contact portion has a first location, where the contact portion is inclined with respect to an attaching direction of the developing device, and a second location, where the contact portion is in parallel with the attaching direction.

The developing device may further include an elastic member providing the contact portion with an elastic force in a direction of returning the contact portion to the first location.

The elastic member may include an elastic arm integrally formed with a housing of the developing device.

According to one or more embodiments, an electrophotographic image forming apparatus includes: a main body including an intermediate transfer belt; a developing device including a photosensitive drum, and attached to/detached from the main body; a memory unit provided in the developing device to transfer information about the developing device to the main body, and including a contact portion to be connected to the main body; and a connection portion provided in the main body and connecting to the contact portion when the developing device is attached to the main body, wherein an attaching path of the developing device includes a first path, in which the developing device is slid in the first direction while the photosensitive drum is separated from the intermediate transfer belt, and a second path, in which the developing device is moved in a second direction that is perpendicular to the first direction to approach the intermediate transfer belt so that the photosensitive drum contacts the intermediate transfer belt, and one of the connection portion and the contact portion has a first location, where the connection portion or the contact portion is inclined with respect to the first direction, and a second location, where the connection portion or the contact portion is in parallel with the first direction.

The connection portion may be supported by the main body to be switched to the first location or the second location, the contact portion may extend in the first direction, and the connection portion may be inclined opposite to the second direction with respect to the first direction at the first location. The electrophotographic image forming apparatus may further include an elastic member providing the connection portion with an elastic force in a direction of returning the connection portion to the first location.

The connection portion may be fixed at a location, the contact portion may be supported by the developing device to be rotatable to the first location or the second location, and the contact portion may be inclined in the second direction with respect to the first direction at the first location. The electrophotographic image forming apparatus may further include an elastic member providing the contact portion with an elastic force in a direction of returning the contact portion to the first location.

BRIEF DESCRIPTION OF THE DRAWINGS

These and/or other aspects will become apparent and more readily appreciated from the following description of the embodiments, taken in conjunction with the accompanying drawings in which:

FIGS. 5A and 5B are schematic diagrams illustrating a process of connecting the connection portion of FIG. 4 to a contact portion, wherein FIG. 5A shows a state in which the connection portion is located at a first location and FIG. 5B shows a state in which the connection portion is located at a second location;

FIGS. 8A and 8B are schematic diagrams illustrating a process of connecting the connection portion of FIG. 7 to a contact portion, wherein FIG. 8A shows a state in which the connection portion is located at a first location and FIG. 8B shows a state in which the connection portion is located at a second location;

FIGS. 11A and 11B are schematic diagrams illustrating a process of connecting the connection portion to the contact portion of FIG. 9, wherein FIG. 11A shows a state in which the contact portion is located at a first location and FIG. 11B shows a state in which the contact portion is located at a second location.

DETAILED DESCRIPTION OF THE PREFERRED EMBODIMENTS

Figure 1:
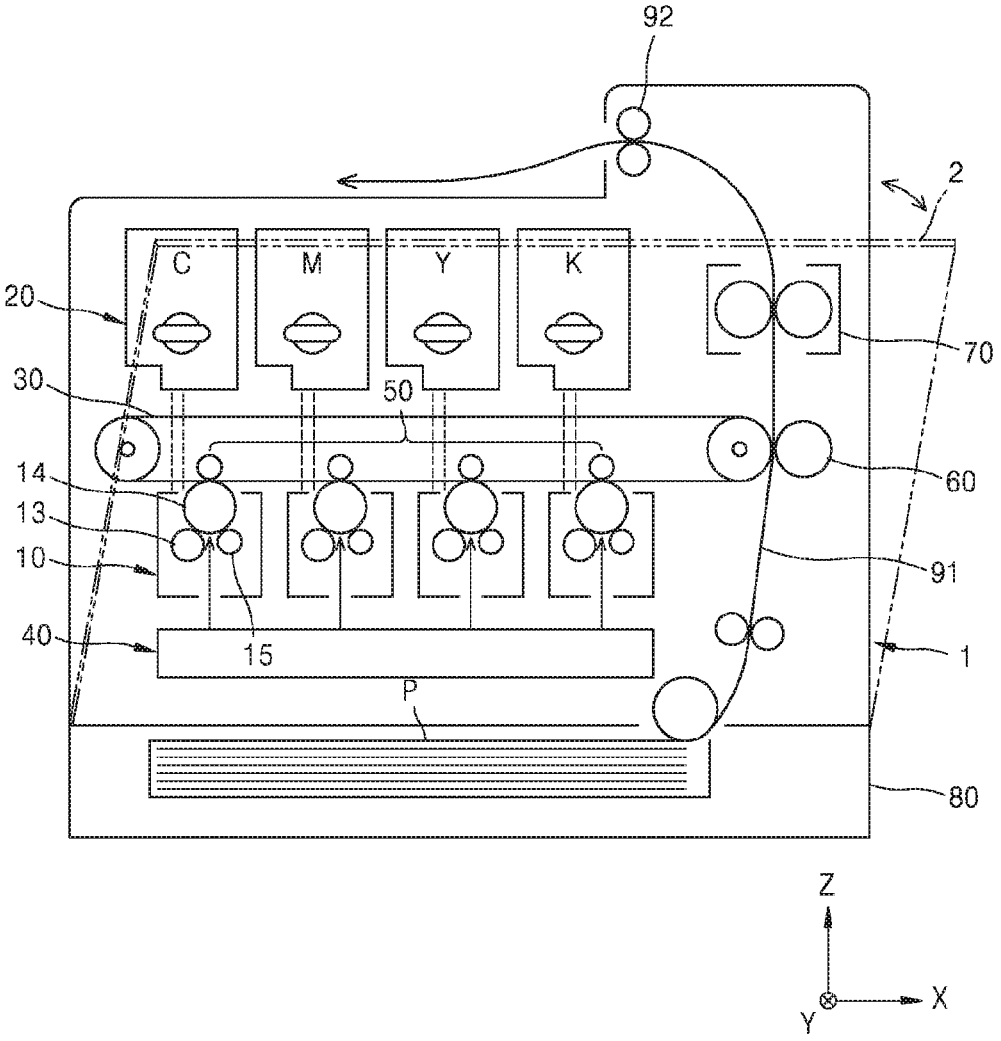
FIG. 1 is a schematic block diagram of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic block diagram of an electrophotographic image forming apparatus according to an embodiment. The image forming apparatus according to the embodiment prints color images in an electrophotographic manner.

Referring to FIG. 1, the image forming apparatus includes a plurality of developing devices 10 and a plurality of developer cartridges 20 in which a developer is contained. The plurality of developer cartridges 20 are respectively connected to the plurality of developing devices 10, and the developers contained in the plurality of developer cartridges 20 are respectively supplied to the plurality of developing devices 10. The plurality of developer cartridges 20 and the plurality of developing devices 10 may be independently replaced with new ones.

The plurality of developing devices 10 may include developing devices 10C, 10M, 10Y, and 10K for respectively developing cyan (C), magenta (M), yellow (Y), and black (K) colors. In addition, the plurality of developer cartridges 20 may include a plurality of developer cartridges 20C, 20M, 20Y, and 20K respectively containing C, M, Y, and K developers that are to be supplied respectively to the plurality of developing devices 10C, 10M, 10Y, and 10K. However, one or more embodiments are not limited thereto, but more developer cartridges 20 and developing devices 10 for containing and developing other developers of various colors such as light magenta and white may be further provided. Hereinafter, the image forming apparatus including the plurality of developing devices 10C, 10M, 10Y, and 10K and the plurality of developer cartridges 20C, 20M, 20Y, and 20K will be described below, and unless otherwise specified, references with C, M, Y, and K refer to elements for developing C, M, Y, and K developers, respectively.

Each of the developing devices 10 includes a photosensitive drum 14 having an electrostatic latent image formed on a surface thereof, and a developing roller 13 supplying the developer supplied from the developer cartridge 20 onto the electrostatic latent image to develop the electrostatic latent image into a visible toner image. The photosensitive drum 14 is an example of a photosensitive member, on which the electrostatic latent image is formed, and may include a conductive metal pipe and a photosensitive layer formed on an outer circumference of the conductive metal pipe. A charging roller 15 is an example of a charger that charges the photosensitive drum 14 to a uniform surface potential. Instead of using the charging roller 15, a charging brush, a corona charger, etc. may be used.

Although not shown in FIG. 1, the developing device 10 may further include a charging roller cleaner for getting rid of impurities such as the developer or dust attached on the charging roller 15, a cleaning member for removing the developer remaining on the surface of the photosensitive drum 14 after an intermediate transfer process that will be described later, and a regulating member for regulating an amount of the developer supplied to a developing region where the photosensitive drum 14 and the developing roller 13 face each other.

When a dual-component development method is used, the developer accommodated in the developer cartridge 20 may be a toner. A carrier may be accommodated in the developing device 10. The developing roller 13 is separate tens to hundreds of micrometers from the photosensitive drum 14. Although not shown in FIG. 1, the developing roller 13 may be a magnetic roller, or may include a developing sleeve and a magnetic roller disposed in the developing sleeve. The toner is mixed with the carrier in the developing device 10, and the toner is attached to a surface of a magnetic carrier. The magnetic carrier is attached to a surface of the developing roller 13 and carried to the developing region where the photosensitive drum 14 and the developing roller 13 face each other. Only the toner is supplied to the photosensitive drum 14 by a developing bias voltage applied between the developing roller 13 and the photosensitive drum 14 so as to develop an electrostatic latent image formed on the surface of the photosensitive drum 14 into a visible image.

When the dual-component development method is used, the developer accommodated in the developer cartridge 20 may include a toner and a carrier, and the toner and the carrier may be supplied to the developing device 10. In this case, in order to maintain a constant ratio between the carrier and the toner in the developing device 10, remaining carrier is discharged to outside of the developing device 10 and accommodated in a waste-carrier container (not shown).

If a mono-component development method that does not include a carrier is used, the developing roller 13 may rotate in contact with the photosensitive drum 14 or may rotate while being separate by tens to hundreds of micrometers from the photosensitive drum 14. The developer cartridge 20 contains the toner, and the developing device 10 may further include a transfer member for agitating and transferring the toner introduced from the developer cartridge 20 to the developing roller 13.

Although not shown in FIG. 1, the developing device 10 may further include a cleaning unit for removing a waste toner remaining on the photosensitive drum 14 after a transfer process that will be described later.

The developing method of the image forming apparatus is described above. However, the developing method is not limited to the above example, but may be variously modified.

An exposure unit 40 irradiates light that is modulated according to image information onto the surface of the photosensitive drum 14 to form the electrostatic latent image on the photosensitive drum 14. Examples of the exposure unit 40 may include a laser scanning unit (LSU) using a laser diode as a light source or a light scanning unit using a light-emitting diode (LED) as a light source.

An intermediate transfer belt 30 temporarily accommodates a toner image developed on the photosensitive drum 14 in each of the plurality of developing devices 10C, 10M, 10Y, and 10K. A plurality of intermediate transfer rollers 50 are disposed to face the photosensitive drums 14 of the plurality of developing devices 10C, 10M, 10Y, and 10K with the intermediate transfer belt 30 interposed therebetween. An intermediate transfer bias voltage is applied to the plurality of intermediate transfer rollers 50 to transfer the images formed on the photosensitive drums 14 to the intermediate transfer belt 30. A corona transfer unit or a transfer unit of a pin scorotron may be used instead of the intermediate transfer roller 50.

A transfer roller 60 is located facing the intermediate transfer belt 30. A transfer bias voltage is applied to the transfer roller 60 for transferring the toner image transferred on the intermediate transfer belt 30 to a recording medium P.

In the embodiment, the image formed on the photosensitive drum 14 is intermediately transferred to the intermediate transfer belt 30, and then, is transferred to the recording medium P that passes between the intermediate transfer belt 30 and the transfer roller 60. However, one or more embodiments are not limited thereto. That is, the recording medium P passes between the intermediate transfer belt 30 and the photosensitive drum 14 so that the image is directly transferred to the recording medium P. In this case, the transfer roller 60 is not provided.

A fusing device 70 applies heat and/or pressure to the toner image transferred onto the recording medium P to fuse the toner image in the recording medium P. The fusing device 70 is not limited to the example shown in FIG. 1.

According to the above configuration, the exposure unit 40 irradiates a plurality of light rays that are modulated according to image information of each color to the photosensitive drums 14 of the plurality of developing devices 10C, 10M, 10Y, and 10K to form electrostatic latent images on the photosensitive drums 14. The electrostatic latent images on the photosensitive drums 14 of the plurality of developing devices 10C, 10M, 10Y, and 10K are developed into visible toner images by the C, M, Y, and K developers supplied from the plurality of developer cartridges 20C, 20M, 20Y, and 20K to the plurality of developing devices 10C, 10M, 10Y, and 10K. The toner images are intermediately transferred to the intermediate transfer belt 30, sequentially. The recording medium P loaded in a paper feed unit 80 is conveyed along a paper feeding path 91 to between the transfer roller 60 and the intermediate transfer belt 30. The toner image intermediately transferred on the intermediate transfer belt 30 is transferred to the recording medium P by the transfer bias voltage applied to the transfer roller 60. When the recording medium P passes through the fusing device 70, the toner image is fixed on the recording medium P due to the heat and pressure. The recording medium P, on which the fusing of the image has finished, is discharged by a discharging roller 92.

Figure 2:
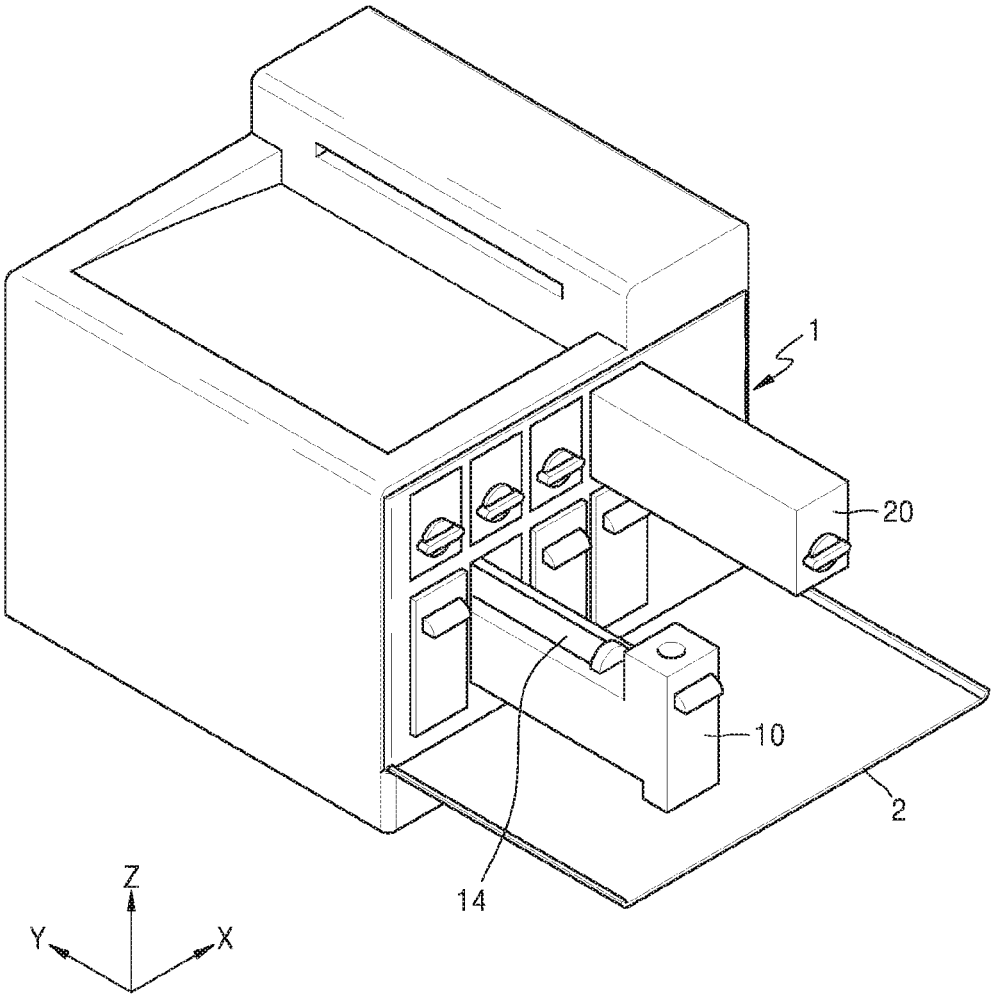
FIG. 2 is a schematic perspective view of an electrophotographic image forming apparatus according to an embodiment.

FIG. 2 is a schematic perspective view of the electrophotographic image forming apparatus according to the embodiment. Referring to FIGS. 1 and 2, the paper feeding path 91 may be projected on an XZ plane, and the developing device 10 and the developer cartridge 20 are slid in a Y-direction that is perpendicular to the XZ plane to be attached to/detached from a main body 1 of the image forming apparatus. That is, the recording medium P is conveyed along the paper feeding path 91 in a lengthwise direction thereof, and the developing device 10 and the developer cartridge 20 may be attached to/detached from the main body 1 of the image forming apparatus in a width direction of the recording medium P, that is, the Y-direction. The width direction of the recording medium P is a length direction of the photosensitive drum 14. The main body 1 may include a door 2 for opening the main body 1 partially to attach/detach the developer cartridge 20 and the developing device 10 to/from the main body 1. The door 2 may open/close a side portion of the main body 1 in an attaching direction (first direction) Y of the developer cartridge 20 and the developing device 10.

Figure 3A:
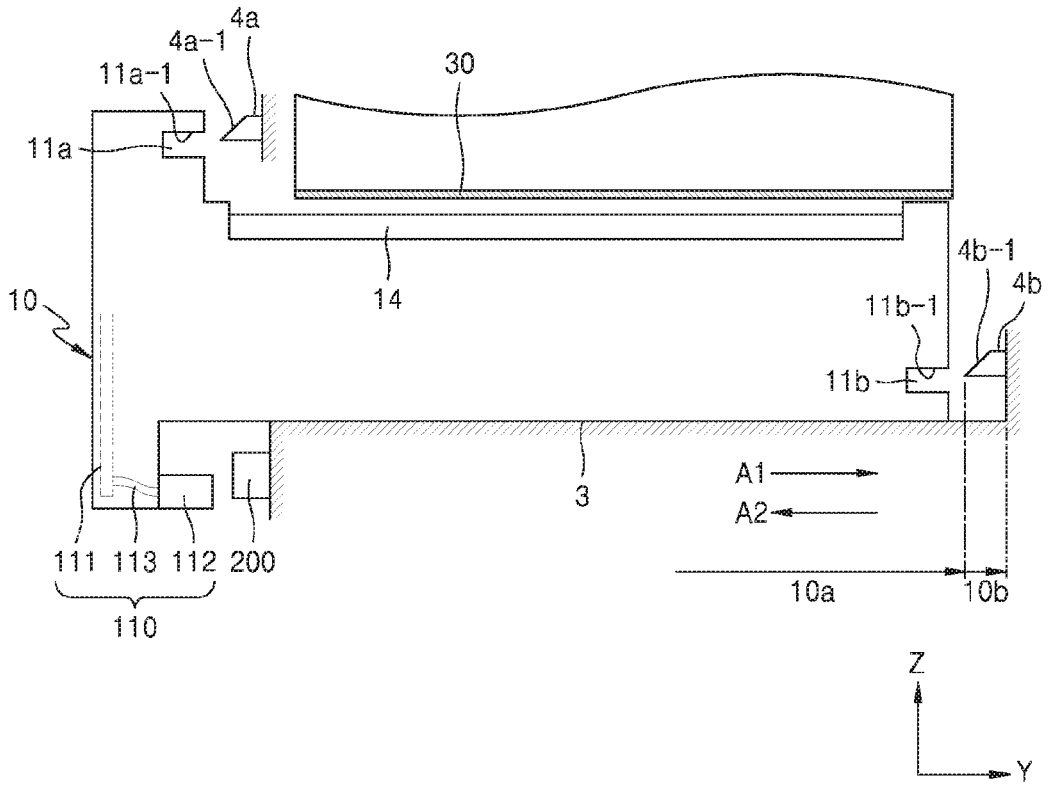
FIGS. 3A and 3B are schematic block diagrams illustrating processes of attaching/detaching a developing device to/from a main body.
Figure 3B:
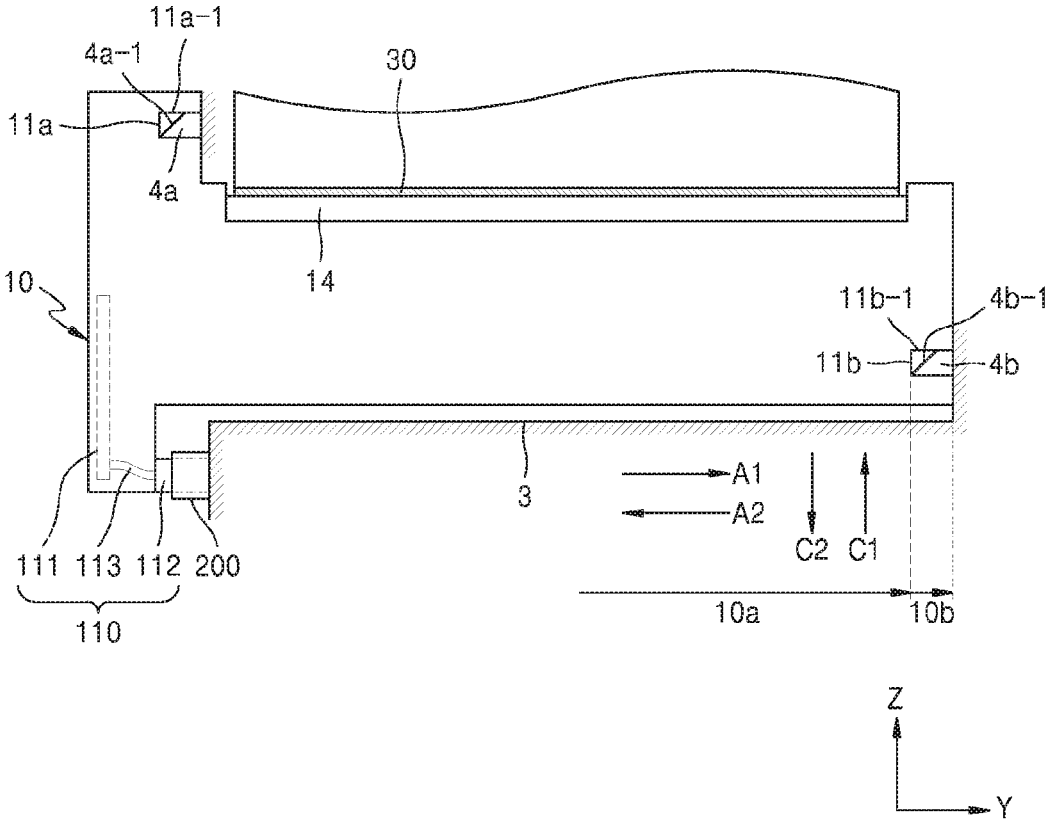

When the developing device 10 is attached to the main body 1, the photosensitive drum 14 contacts the intermediate transfer belt 30. While the developing device 10 is slid in the first direction Y to be attached to the main body 1, when the photosensitive drum 14 and the intermediate transfer belt 30 contact each other, the photosensitive drum 14 and/or the intermediate transfer belt 30 may be damaged. The above problem may be addressed, when the developing device 10 is attached to the main body, such that the developing device 10 may be slid in the first direction Y while maintaining a gap between the photosensitive drum 14 and the intermediate transfer belt 30 and the developing device 10 is moved in a second direction Z toward the intermediate transfer belt 30 at a time when the attaching is nearly finished. FIGS. 3A and 3B are schematic block diagrams showing a process of attaching/detaching the developing device 10 to/from the main body 1. FIG. 3A shows a state in which the photosensitive drum 14 is separate from the intermediate transfer belt 30, and FIG. 3B shows a state in which the developing device 10 is attached to the main body 1 and the photosensitive drum 14 contacts the intermediate transfer belt 30.

Referring to FIG. 3A, the main body 1 includes an attaching rail 3 extending in the first direction Y. The developing device 10 is guided by the attaching rail 3, and is slid in the first direction Y as denoted by an arrow A1. Here, the photosensitive drum 14 is separate from the intermediate transfer belt 30. The main body 1 includes first guide members 4*a* and 4*b* for guiding the developing device 10 to approach to the intermediate transfer belt 30. For example, two first guide members 4*a* and 4*b* are provided in the first direction Y. The first guide members 4*a* and 4*b* respectively include guide surfaces 4*a*-1 and 4*b*-1 that are upwardly inclined in the second direction Z, along the attaching direction of the developing device 10, that is, the first direction Y. The developing device 10 includes second guide members 11*a* and 11*b* respectively corresponding to the first guide members 4*a* and 4*b*. The second guide members 11*a* and 11*b* may be formed as recesses, in which the first guide members 4*a* and 4*b* are respectively inserted. When the developing device 10 is slid in the first direction Y, the first guide members 4*a* and 4*b* are inserted in the second guide members 11*a* and 11*b*. The second guide members 11*a* and 11*b* respectively include guide portions 11*a*-1 and 11*b*-1 contacting the guide surfaces 4*a*-1 and 4*b*-1. The guide portions 11*a*-1 and 11*b*-1 may be formed as, for example, planes extending in the first direction Y. Although not shown in FIGS. 3A and 3B, the guide portions 11*a*-1 and 11*b*-1 may be formed as protrusions.

When the guide surfaces 4*a*-1 and 4*b*-1 start to contact the guide portions 11*a*-1 and 11*b*-1, the developing device 10 is separate from the attaching rail 3 as denoted by an arrow C1 of FIG. 3B and is moved toward the intermediate transfer belt 30, that is, in the second direction Z. When the attaching of the developing device 10 is finished, the photosensitive drum 14 contacts the intermediate transfer belt 30 as shown in FIG. 3B.

The developing device 10 may be detached from the main body 1 by sliding in a direction opposite to the first direction Y as denoted by an arrow A2. Here, the developing device 10 is guided by the guide surfaces 4*a*-1 and 4*b*-1 to be moved away from the intermediate transfer belt 30, that is, in a direction opposite to the second direction Z as denoted by an arrow C2, and then, the photosensitive drum 14 is separate from the intermediate transfer belt 30. In this state, the developing device 10 may be guided by the attaching rail 3 to be detached from the main body 1.

In the above embodiment, the first guide members 4*a* and 4*b* are convex and the second guide members 11*a* and 11*b* are concave for accommodating the first guide members 4*a* and 4*b*; however, the second guide members 11*a* and 11*b* may be convex and the first guide members 4*a* and 4*b* may be concave for accommodating the second guide members 11*a* and 11*b*.

Referring to FIGS. 3A and 3B, the developing device 10 includes a memory unit 110. When the developing device 10 is attached to the main body 1, the memory unit 110 is electrically connected to the main body 1 to transfer information about the developing device 10 to the main body 1. The main body 1 may determine the attached state of the developing device 10, based on whether the memory unit 110 is electrically connected thereto, for example, whether the main body 1 is able to communicate with the memory unit 110.

The memory unit 110 may include a circuit portion 111 for monitoring or managing the developing device 10, and a contact portion 112 for connecting to the main body 1. The circuit portion 111 may include a customer replaceable unit monitor (CRUM) including a central processor unit (CPU) performing at least one of a verification and/or encrypted data communication with the main body 1 by using an operating system (OS) of itself. The circuit portion 111 may further include a memory. The memory may store various kinds of information about the developing device 10. For example, the memory may store information about a manufacturer of the developing device 10, information about a manufacturing date, exclusive information such as a serial number, a model name, etc., and information about various programs, electronic signature information, and usage status (e.g., how many sheets of recording media have been printed, how many sheets of recording media are remained to be printable, etc.). Also, the memory may store information about lifespan of the developing device 10, a setup menu, etc. Besides, the circuit portion 111 may include a functional block capable of performing various functions for communicating, verifying, and encrypting with respect to the main body 1. The circuit portion 111 may be implemented as a chip including a CPU, a chip including a memory and a CPU, and a printed circuit board on which circuit devices for implementing chips and various functional blocks are mounted.

The contact portion 112 may be formed integrally with the printed circuit board of the circuit portion 111, or as shown in FIGS. 3A and 3B, may be connected to the circuit portion 111 via a signal line 113. The contact portion 112 may be, for example, a modular jack. The main body 1 includes a connection portion 200 connecting to the contact portion 112. The connection portion 200 may be formed as a modular connector, in which the contact portion 112 of the modular jack type is inserted.

When the developing device 10 is attached to the main body 1, the developing device is first inserted and moved along an attaching path so that the contact portion 112 is connected to the connection portion 200 provided on the main body 1. As described above, the attaching path of the developing device 10 includes a first path 10*a*, in which the developing device 10 is slid in the first direction Y while the photosensitive drum 14 is separate from the intermediate transfer belt 30, and a second path 10*b* in which the developing device 10 is moved in the second direction Z that is perpendicular to the first direction Y to approach the intermediate transfer belt 30 so that the photosensitive drum 14 may contact the intermediate transfer belt 30. Therefore, in an attaching process, the developing device 10 is moved in the second direction Z that is perpendicular to the first direction Y in stages while moving the first direction Y. When the developing device 10 is separate from the attaching rail 3 and the photosensitive drum 14 contacts the intermediate transfer belt 30, the attaching operation of the developing device 10 is finished. Therefore, the contact portion 112 should be connected to the connection portion 200 while the developing device 10 moves in the second direction Z simultaneously, while moving in the first direction Y, and the photosensitive drum 14 contacts the intermediate transfer belt 30.

Considering the attaching process of the developing device 10 to the main body 1, at least one of the contact portion 112 and the connection portion 200 needs to change its posture or location in order to compensate for the movement in the second direction Z of the developing device 10.

First, embodiments in which the posture or the location of the connection portion 200 changes in order to compensate for the movement of the developing device 10 in the second direction Z will be described below.

Figure 4:
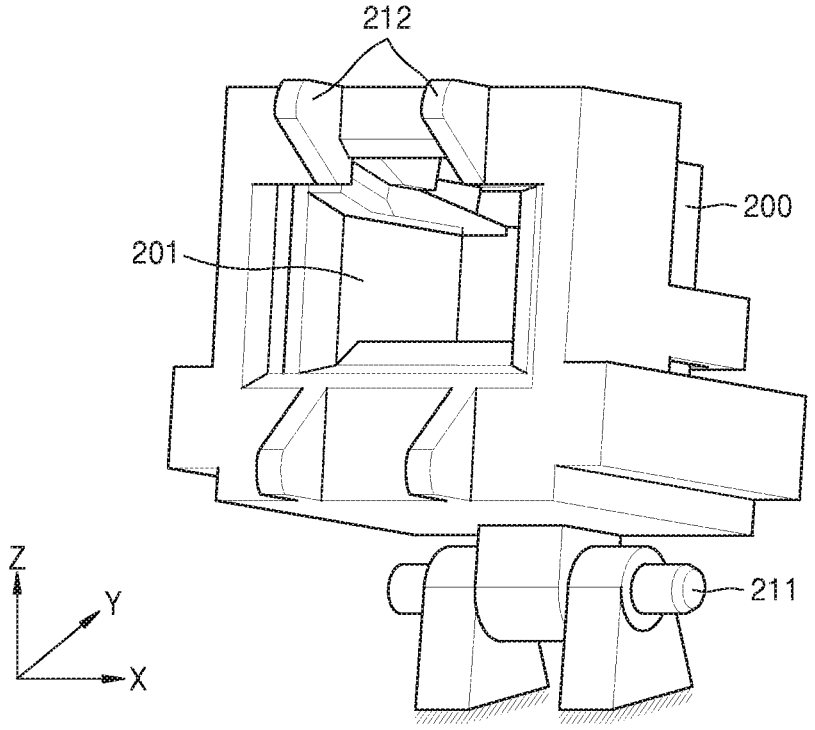
FIG. 4 is a schematic perspective view of a connection portion, according to an embodiment.
Figure 5A:
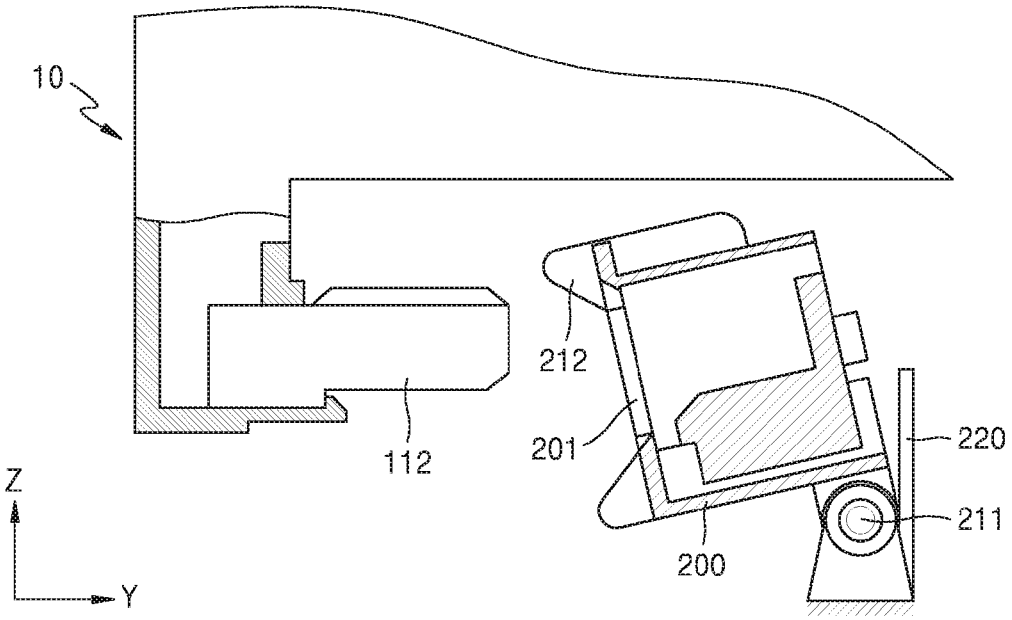
Figure 5B:
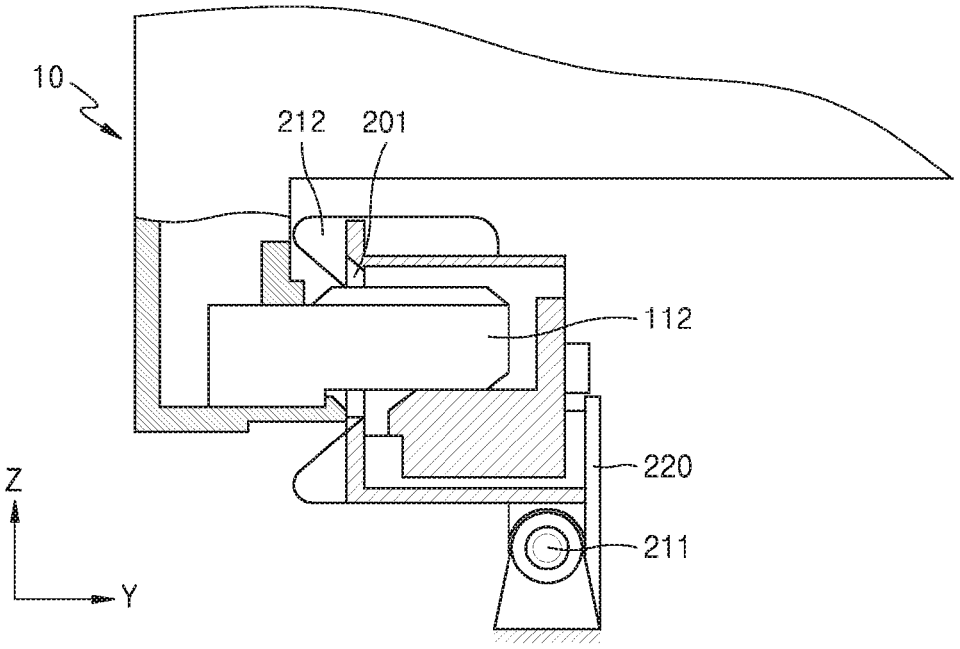

FIG. 4 is a schematic perspective view of the connection portion 200. FIGS. 5A and 5B are schematic diagrams showing processes of connecting the connection portion 200 to the contact portion 112 according to the embodiment illustrated in FIG. 4. FIG. 5A shows a state in which the connection portion 200 is located at a first location, and FIG. 5B shows a state in which the connection portion 200 is located at a second location.

Referring to FIGS. 4, 5A, and 5B, the connection portion 200 includes an insertion hole 201 in which the contact portion 112 is inserted. The contact portion 112 extends in the first direction Y. The connection portion 200 has a first location (FIG. 5A) that is inclined with respect to the first direction Y, and a second location (FIG. 5B) that is in parallel with the contact portion 112, that is, the first direction Y. The connection portion 200 is aligned with the contact portion 112 in the first direction Y at the second location.

In the embodiment, the connection portion 200 is supported by the main body 1 to be rotatable to the first location and the second location. For example, the connection portion 200 includes a rotary shaft 211 extending in the X-direction. The rotary shaft 211 is supported by the main body 1 to be rotatable. At the first location, the connection portion 200 is downwardly inclined with respect to the first direction Y, that is, the connection portion 200 is inclined in a direction opposite to the second direction Z with respect to the first direction Y at the first location.

A guide rib 212 is provided in front of the insertion hole 201, wherein the guide rib 212 contacts a front edge portion of the contact portion 112 to guide the contact portion 112 to the insertion hole 201 in a state where the connection portion 200 is located at the first location. The guide rib 212 may be disposed at a side of the insertion hole 201 in the second direction Z, for example, a side in a rotating direction of the connection member 200. In the embodiment, the second direction Z is opposite to a gravity direction, and the guide rib 212 is provided at a side portion of the insertion hole 201 in a direction opposite to the gravity direction, that is, an upper side portion. Location of the rotary shaft 211 may be determined taking into account a centroid of the connection portion 200, so that the connection portion 200 may be naturally returned to the first location from the second location. That is, by appropriately setting the location of the rotary shaft 211, the connection portion 200 may be rotated from the second location to the first location due to a weight of itself.

FIG. 5A shows a state in which the developing device 10 is slid in the first direction Y, before the first guide members 4*a* and 4*b* and the second guide members 11*a* and 11*b* contact each other, that is, before the developing device 10 is moved in the second direction Z. The connection portion 200 is located at the first location. The connection portion 200 is in a downwardly inclined state. Therefore, it is difficult for dust, the toner and the developer falling down from the developer cartridge 20 or the developing device 10 to be introduced into the connection portion 200 via the insertion hole 201. Therefore, a probability of contaminating the connection portion 200 due to impurities may be reduced, and accordingly, a possibility of generating an electrical connection defect between the contact portion 112 and the connection portion 200 due to the impurities may be reduced.

In this state, when the developing device 10 is further slid in the first direction Y, the front edge of the contact portion 112 contacts the guide rib 212, and the connection portion 200 is pushed by the contact portion and rotated about the rotary shaft 211 toward the second location.

When the attaching of the developing device 10 is finished, the connection portion 200 reaches the second location that is in parallel with the contact portion 112 as shown in FIG. 5B, and the contact portion 112 is inserted to the connection portion 200. As such, the memory unit 110 in the developing device 10 is electrically connected to the main body 1. The main body 1 may include a stopper 220 for blocking the connection portion 200 not to further rotate beyond the second location.

When the developing device 10 is detached from the main body 1, the contact portion 112 escapes from the connection portion 200, and the connection portion 200 rotates about the rotary shaft 211 due to the weight of itself to return to the first location as shown in FIG. 5A from the second location.

According to the above configuration, when the developing device 10 is moved in the second direction Z that is perpendicular to the first direction Y in stages while moving in the first direction Y to be attached to the main body 1, the contact portion 112 of the developing device 10 may be stably connected to the connection portion 200 provided in the connection portion 200.

Figure 6:
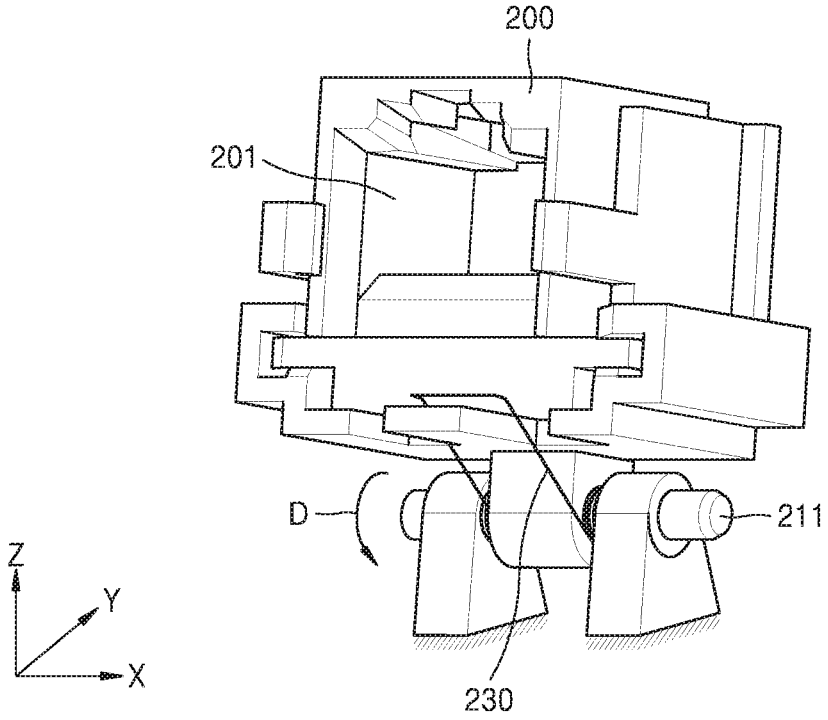
FIG. 6 is a schematic perspective view of a connection portion according to an embodiment.

FIG. 6 is a schematic perspective view of the connection portion 200 according to an embodiment. The connection portion 200 of the embodiment is the same as that of FIG. 4, except that an elastic member 230 for providing the connection portion 200 with an elastic force is provided so that the connection portion 200 is rotated in a direction D toward the first location. Referring to FIG. 6, the elastic member 230 may be, for example, a torsion coil spring.

According to the above configuration, when the developing device 10 is attached to the main body 1, the contact portion 112 interferes with the connection portion 200, and the connection portion 200 is rotated opposite to a direction, in which the elastic force of the elastic member 230 is applied, to switch to the second location. On the other hand, when the developing device 10 is detached from the main body 1, as the contact portion 112 is separate from the connection portion 200, the connection portion 200 is returned to the first location by the elastic force of the elastic member 230.

Although not shown in FIG. 6, like in the embodiment illustrated with reference to FIG. 4, the guide rib 212 may be provided in front of the insertion hole 201, wherein the guide rib 212 contacts the front edge of the contact portion 112 in a state where the connection portion 200 is located at the first location, in order to guide the contact portion 112 to the insertion hole 201.

Figure 7:
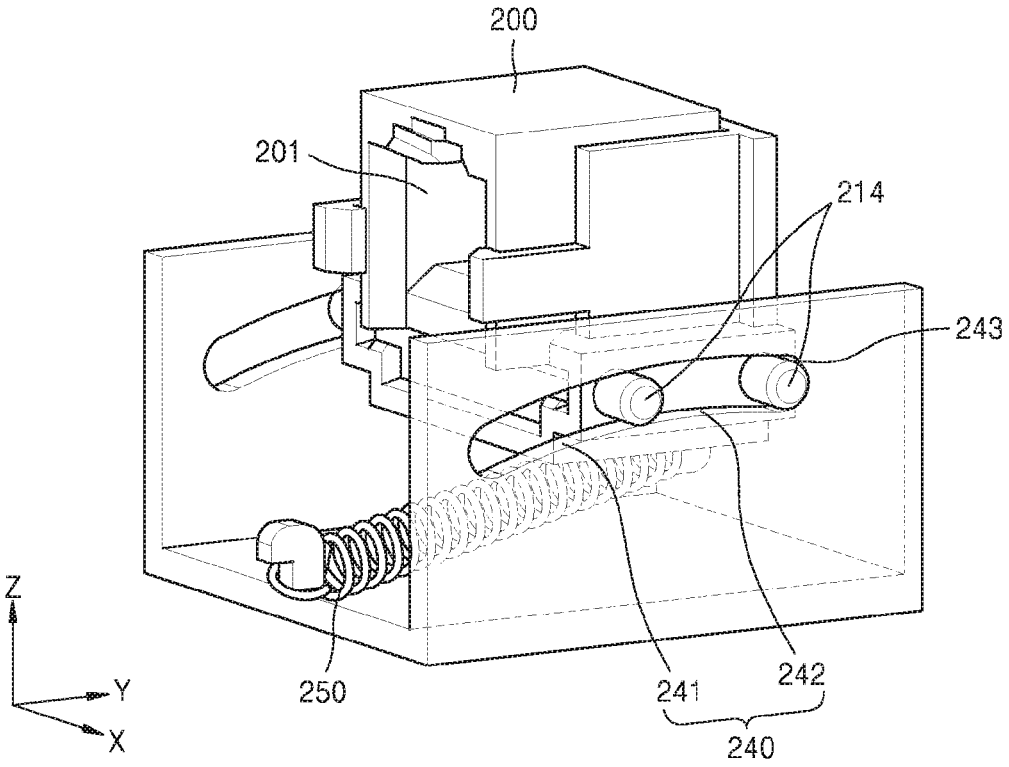
FIG. 7 is a schematic perspective view of a connection portion according to an embodiment.
Figure 8A:
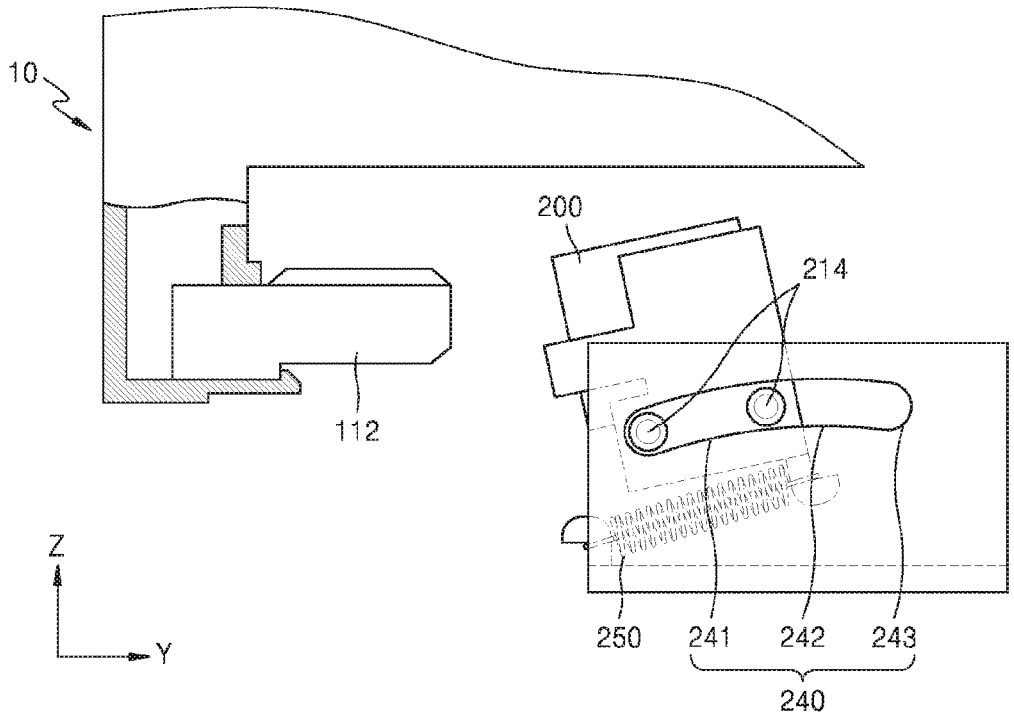
Figure 8B:
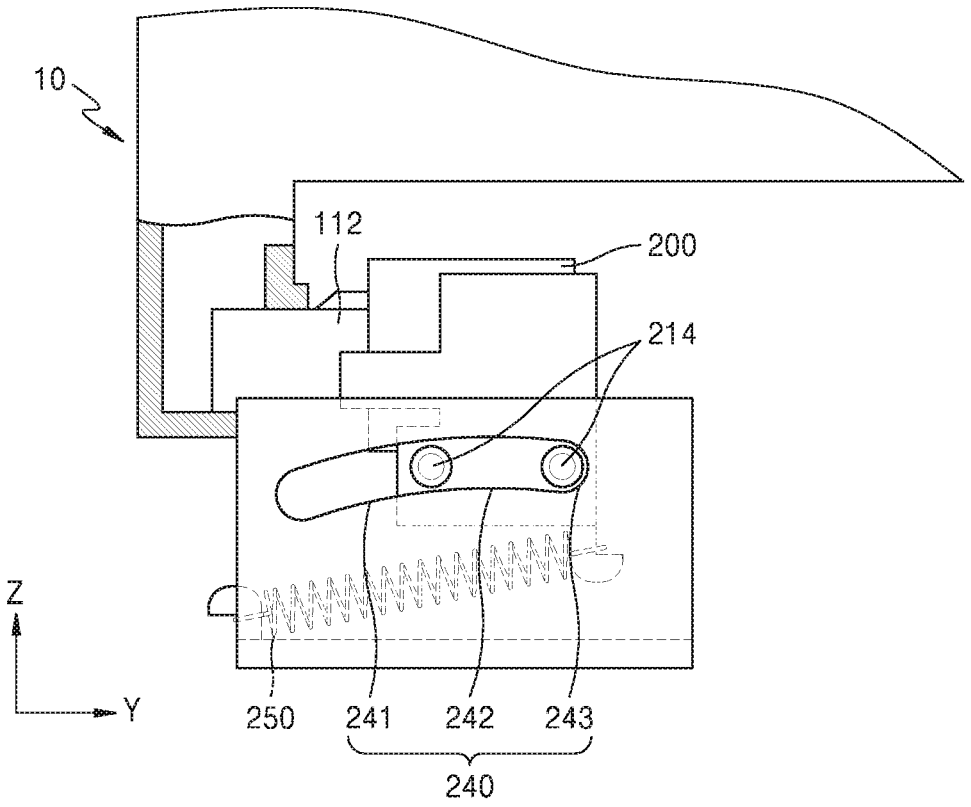

FIG. 7 is a schematic perspective view of the connection portion 200 according to an embodiment. FIGS. 8A and 8B are schematic diagrams illustrating processes of connecting the connection portion 200 to the contact portion 112 in the embodiment of FIG. 7. FIG. 8A shows a state where the connection portion 200 is located at the first location, and FIG. 8B shows a state where the connection portion 200 is located at the second location. The connection portion 200 of the embodiment is slid in the attaching direction of the developing device 10, that is, in the first direction Y, and at the same time, is rotated to the first or second location.

Referring to FIGS. 7, 8A, and 8B, the main body 1 includes a guide rail 240. The connection portion 200 includes guide protrusions 214 guided by the guide rail 240. At least two guide protrusions 214 are provided. In the embodiment, two guide protrusions 214 are provided. The guide rail 240 includes an inclined section 241 that is inclined in the second direction Z, and a horizontal section 242 extending in the first direction Y. An inclination of the connection portion 200 in the second direction Z varies depending on the location of the guide protrusions 214 within the guide rail 240. When the guide protrusions 214 are located in the inclined section 241, the connection portion 200 is located at the first location (FIG. 8A) where the connection portion 200 is downwardly inclined to a direction opposite to the second direction Z. When the guide protrusions 214 are located in the horizontal section 242, the connection portion 200 is located at the second location (FIG. 8B) where the connection portion 200 is in parallel with the contact portion 112. The elastic member 250 applies an elastic force to the connection member 200 in a direction of switching to the first location. In the embodiment, a tensile coil spring is used as the elastic member 250.

FIG. 8A shows a state, in which the developing device 10 is slid in the first direction Y, before the first guide members 4*a* and 4*b* and the second guide members 11*a* and 11*b* contact each other, that is, before the developing device 10 is moved in the second direction Z. The guide protrusions 214 are located in the inclined section 241, and the connection member 200 is located at the first location. The connection portion 200 is in an inclined state so that the insertion 210 faces downward in the gravity direction. Therefore, it is difficult for dust, the toner and the developer falling down from the developer cartridge 20 or the developing device 10 to be introduced into the connection portion 200 via the insertion hole 201. Therefore, a probability of contaminating the connection portion 200 due to impurities may be reduced, and accordingly, a possibility of occurrence of an electric connection defect between the connection portion 200 and the contact portion 112 due to the impurities may be reduced.

In the above state, when the developing device 10 is further slid in the first direction Y, a front edge of the contact portion 112 contacts the connection portion 200, and the connection portion 200 is pushed by the contact portion 112 and moved along the guide rail 240 in an opposite direction to the direction, in which the elastic force of the elastic member 250 is applied. As locations of the guide protrusions 214 in the guide rail 240 vary, the connection portion 200 is rotated in the second direction Z to be switched to the second location.

When attaching of the developing device 10 is finished, the guide protrusions 214 are located in the horizontal section 242, and as shown in FIG. 8B, the connection portion 200 reaches the second location, where the connection portion 200 is in parallel with the contact portion 112. The contact portion 112 is inserted to the connection portion 200. As such, the memory unit 110 in the developing device 10 is electrically connected to the main body 1. An end portion of the guide rail 240, that is, an end portion 243 of the horizontal section 242 functions as a stopper for blocking the connection portion 200 not to further slide and rotate beyond the second location. That is, when the guide protrusions 214 reach the end portion 243 of the horizontal section 242, the connection portion 200 is not moved any further and stays at the second location.

When the developing device 10 is detached from the main body 1, the contact portion 112 escapes from the connection portion 200, and the connection portion is moved along the guide rail 240 due to the elastic force of the elastic member 250. The guide protrusions 214 enter the inclined section 241 from the horizontal section 242, and the connection member 200 returns to the first location, where the connection member 200 is downwardly inclined in the second direction Z.

According to the above configuration, when the developing device 10 that is moved in the second direction Z that is perpendicular to the first direction Y in stages while moving the first direction Y to be attached to the main body 1 is provided, the contact portion 112 in the developing device 10 may be stably connected to the connection portion 200 in the main body 1.

In the above embodiments, the structure in which the connection portion 200 is switched to the first location or the second location is described, but one or more embodiments are not limited thereto. The connection portion 200 is fixed at a location, and the contact portion 112 may be switched to a first location or a second location.

Figure 9:
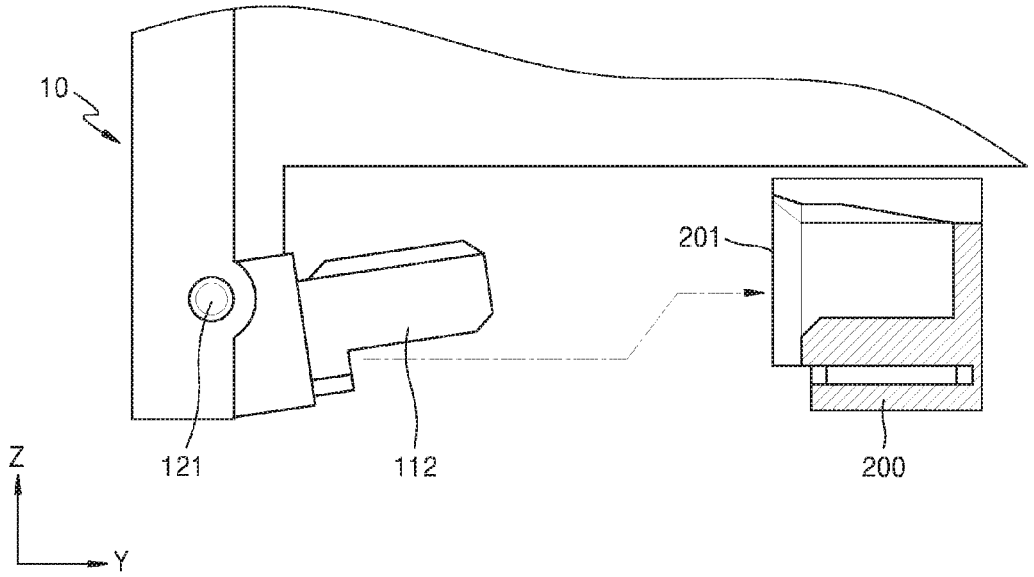
FIG. 9 is a schematic side view of a contact portion according to an embodiment.
Figure 10:
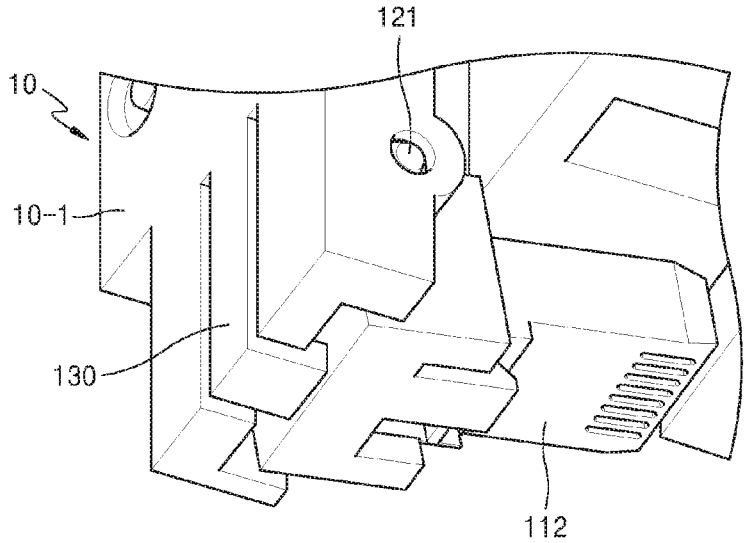
FIG. 10 is a schematic perspective view of the contact portion of FIG. 9.
Figure 11A:
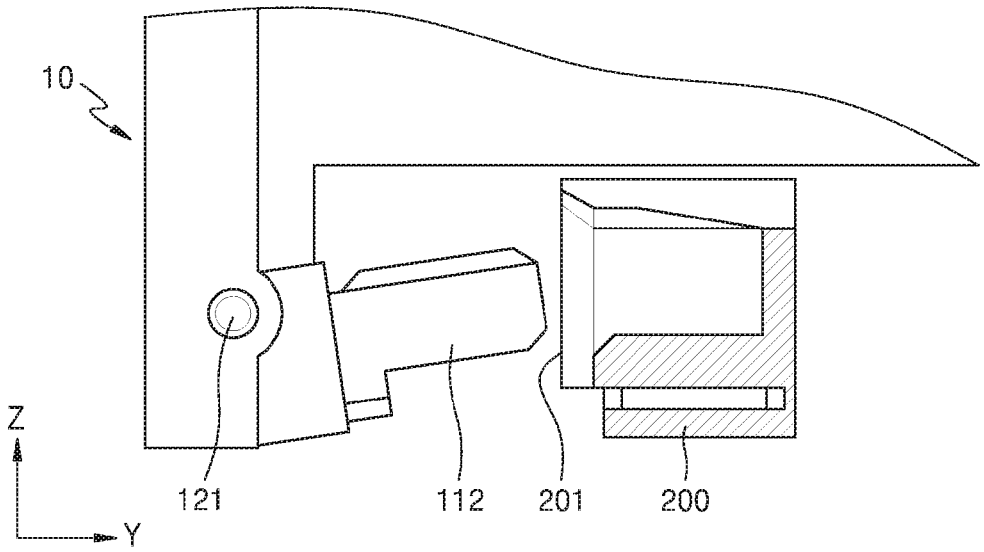
Figure 11B:
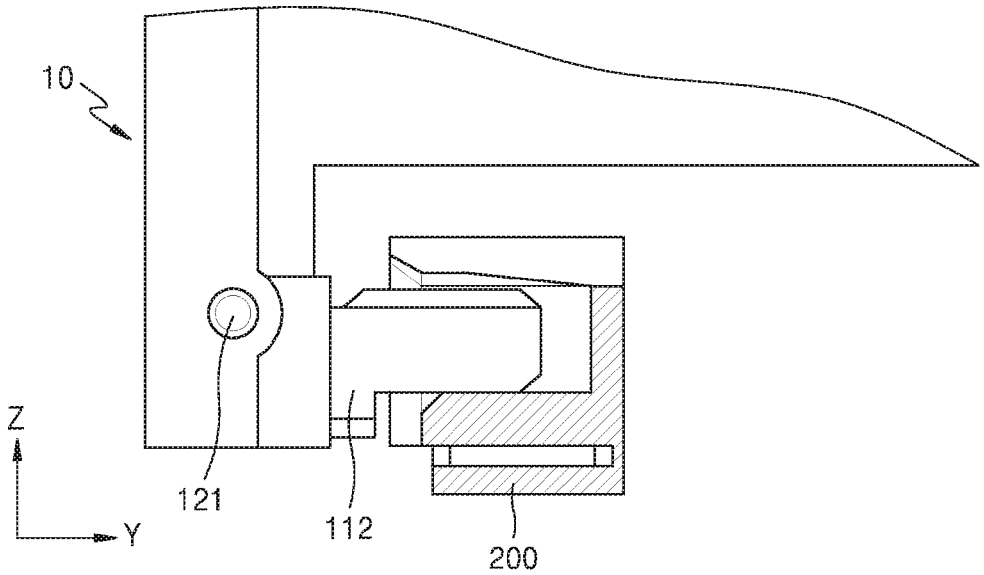

FIG. 9 is a schematic side view of the contact portion 112 according to an embodiment. FIG. 10 is a schematic perspective view of the contact portion 112 of FIG. 9. FIGS. 11A and 11B are schematic diagrams illustrating processes of connecting the connection portion 200 to the contact portion 112 of FIG. 9. FIG. 11A shows a state in which the contact portion 112 is located at the first location, and FIG. 11B shows a state in which the contact portion 112 is located at the second location.

Referring to FIGS. 9, 10, 11A, and 11B, the contact portion 112 is provided on the developing device 10 to be rotatable in the second direction Z. The contact portion 112 has a first location (FIG. 11A) where the contact portion 112 is inclined in the second direction Z, and a second location (FIG. 11B) where the contact portion 112 is in parallel with the connection portion 200, that is, the first direction Y. For example, the contact portion 112 is provided on the developing device 10 so as to rotate about the rotary shaft 121 to the first location or the second location. An elastic member may be further provided to apply an elastic force to the contact portion 112 in a direction of maintaining the contact portion 112 at the first location. For example, as shown in FIG. 10, the elastic member may be implemented by an elastic arm 130 provided on a side wall of a housing 10-1 of the developing device 10. According to the above configuration, the number of components may be reduced. Examples of the elastic member may be various, e.g., a torsion coil spring as shown in FIG. 6, and a plate spring that may substitute for the elastic arm 130. The connection portion 200 is fixed on the main body 1. Location of the connection portion 200 may be determined so that the contact portion 112 located at the second location may be inserted to the connection portion 200.

FIG. 11A shows a state, when the developing device 10 is slid in the first direction Y, before the first guide members 4*a* and 4*b* and the second guide members 11*a* and 11*b* contact each other, that is, before the developing device 10 is moved in the second direction Z. The contact portion 112 does not contact the connection portion 200 yet, and is located at the first location where the contact portion 112 is upwardly inclined in the second direction Z.

In this state, when the developing device 10 is further slid in the first direction Y, the front edge of the contact portion 112 contacts the connection portion 200. The first guide members 4*a* and 4*b* and the second guide members 11*a* and 11*b* interfere with each other so that the developing device 10 starts to elevate in the second direction Z, and then, the contact portion 112 starts to rotate about the rotary shaft 121 in an opposite direction to the direction, in which the elastic force of the elastic arm 130 is applied, that is, opposite to the second direction Z, for switching to the second location.

When attaching of the developing device 10 is finished, the contact point 112 reaches the second location where the contact portion 112 is in parallel with the connection portion 200, and the contact portion 112 is inserted to the connection portion 200. As such, the memory unit 110 in the developing device 10 is electrically connected to the main body 1.

When the developing device 10 is detached from the main body 1, the contact portion 112 escapes from the connection portion 200, and the contact portion 112 may be returned to the first location, where the contact portion 112 is upwardly inclined in the second direction Z, by the elastic force of the elastic arm 130.

According to the above configuration, when the developing device 10 that is moved in the second direction Z that is perpendicular to the first direction Y in stages while moving the first direction Y to be attached to the main body 1 is provided, the contact portion 112 in the developing device 10 may be stably connected to the connection portion 200 in the main body 1.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. An electrophotographic image forming apparatus comprising:

a main body comprising a connection portion; and a developing device configured to be attached to and detached from the main body, the developing device including:

a memory unit configured to provide information about the developing device to the main body, and a contact portion configured to be connected to the main body for connecting the memory unit to the main body;

wherein:

the connection portion is configured to be connected to the contact portion when the developing device is attached to the main body, and one of the connection portion and the contact portion is configured to be positioned at:

a first location while the connection portion is not connected to contact portion, where the one of the connection portion and the contact portion is inclined with respect to an attaching direction of the developing device to the main body, and a second location while the connection portion is connected to the contact portion and the contact portion is connected to the main body for connecting the memory unit to the main body, where the one of the connection portion and the contact portion is in parallel with the attaching direction.

2. The electrophotographic image forming apparatus of claim 1, wherein the connection portion is supported by the main body to be switched to the first location or the second location.

3. The electrophotographic image forming apparatus of claim 2, wherein the contact portion extends in the attaching direction, and the connection portion is inclined downwardly with respect to the attaching direction when the connection portion is positioned at the first location.

4. The electrophotographic image forming apparatus of claim 3, wherein the connection portion is supported by the main body so as to rotatable to the first location or the second location.

5. The electrophotographic image forming apparatus of claim 4, further comprising a stopper for blocking the connection portion to limit the rotation of the connection portion up to the second location.

6. The electrophotographic image forming apparatus of claim 4, wherein the connection portion comprises:

an insertion hole, through which the contact portion is inserted, and a guide rib provided at an upper side portion of the insertion hole configured to guide the contact portion toward the insertion hole.

7. The electrophotographic image forming apparatus of claim 4, further comprising an elastic member providing the connection portion with an elastic force in a direction of returning the connection portion to the first location from the second location.

8. The electrophotographic image forming apparatus of claim 3, further comprising:

a guide rail provided in the main body, the guide rail comprising:

an inclined section that is inclined downwardly with respect to the attaching direction, and a horizontal section extending in the attaching direction; and at least two guide protrusions provided on the connection portion configured to be inserted in the guide rail, wherein the connection portion is configured to be guided to the inclined section or the horizontal section by being pushed by the contact portion, to be switched from the first location to the second location when the developing device is attached to the main body.

9. The electrophotographic image forming apparatus of claim 8, further comprising an elastic member for providing the connection portion with an elastic force in a direction of returning the connection portion to the first location from the second location.

10. The electrophotographic image forming apparatus of claim 1, wherein the contact portion is supported by the developing device to be rotatable to the first location and to the second location.

11. The electrophotographic image forming apparatus of claim 10, wherein the contact portion is upwardly inclined with respect to the attaching direction when the contact portion is positioned at the first location.

12. The electrophotographic image forming apparatus of claim 11, further comprising an elastic member for providing the contact portion with an elastic force in a direction of returning the contact portion to the first location from the second location.

13. A developing device configured to be attached to and detached from a main body of an image forming apparatus, the developing device including:

a memory unit configured to provide information about the developing device to the main body, and a contact portion configured to be connected to the main body for connecting the memory unit to the main body, wherein the contact portion is configured to be positioned at:

a first location while the contact portion is not connected to the main body, where the contact portion is inclined with respect to an attaching direction of the developing device, and a second location while the contact portion is connected to the main body for connecting the memory unit to the main body, where the contact portion is in parallel with the attaching direction.

14. The developing device of claim 13, further comprising an elastic member providing the contact portion with an elastic force in a direction of returning the contact portion to the first location from the second location.

15. The developing device of claim 14, wherein the elastic member comprises an elastic arm integrally formed with a housing of the developing device.

16. An electrophotographic image forming apparatus comprising:

a main body comprising:

an intermediate transfer belt, and a connection portion; and a developing device configured to be attached to and detached from the main body and to be moved along an attaching path to be attached to the main body, the developing device including:

a photosensitive drum, a memory unit configured to provide information about the developing device to the main body, and a contact portion configured to be connected to the main body for connecting the memory unit to the main body;

wherein:

the connection portion is configured to be connected to the contact portion when the developing device is attached to the main body, the attaching path of the developing device includes:

a first path in which the developing device is slid in a first direction while the photosensitive drum is separated from the intermediate transfer belt, and a second path in which the developing device is moved in a second direction that is perpendicular to the first direction to approach the intermediate transfer belt so that the photosensitive drum contacts the intermediate transfer belt, and one of the connection portion and the contact portion is configured to be positioned at:

a first location, where the one of the connection portion and the contact portion is inclined with respect to the first direction, and a second location, where the one of the connection portion or the contact portion is in parallel with the first direction.

17. The electrophotographic image forming apparatus of claim 16, wherein:

the connection portion is supported by the main body to be switched to the first location or the second location, the contact portion extends in the first direction, and when the connection portion is positioned at the first location, the connection portion is inclined:

opposite to the second direction, and with respect to the first direction.

18. The electrophotographic image forming apparatus of claim 17, further comprising an elastic member providing the connection portion with an elastic force in a direction of returning the connection portion to the first location from the second location.

19. The electrophotographic image forming apparatus of claim 16, wherein:

the contact portion is supported by the developing device to be rotatable to the first location and to the second location, and the contact portion is inclined in the second direction and with respect to the first direction when the contact portion is positioned at the first location.

20. The electrophotographic image forming apparatus of claim 19, further comprising an elastic member providing the contact portion with an elastic force in a direction of returning the contact portion to the first location from the second location.

* * * * *